US011466829B2

(12) United States Patent
Zeng et al.

(10) Patent No.: US 11,466,829 B2
(45) Date of Patent: Oct. 11, 2022

(54) FLAME LAMP MADE OF FILAMENT LAMPS

(71) Applicant: ZHEJIANG TWINSEL ELECTRONIC TECHNOLOGY CO., LTD., Ningbo (CN)

(72) Inventors: Xueren Zeng, Ningbo (CN); Qian Xu, Ningbo (CN); Xueyi Zeng, Ningbo (CN); Zhenzhong Kong, Ningbo (CN); Jiawei Li, Ningbo (CN); Rongqu Tang, Ningbo (CN); Xiaofeng Tang, Ningbo (CN)

(73) Assignee: ZHEJIANG TWINSEL ELECTRONIC TECHNOLOGY CO., LTD., Ningbo (CN)

( * ) Notice: Subject to any disclaimer, the term of this patent is extended or adjusted under 35 U.S.C. 154(b) by 0 days.

(21) Appl. No.: 17/147,242

(22) Filed: Jan. 12, 2021

(65) Prior Publication Data

US 2022/0154901 A1 May 19, 2022

(30) Foreign Application Priority Data

Nov. 13, 2020 (CN) ..... 202011273181.7

(51) Int. Cl.
*F21S 10/04* (2006.01)
*F21S 9/02* (2006.01)
(Continued)

(52) U.S. Cl.
CPC ..... *F21S 10/043* (2013.01); *F21S 9/02* (2013.01); *F21V 21/0824* (2013.01); *F21Y 2115/10* (2016.08)

(58) Field of Classification Search
CPC ..... F21K 9/232; F21K 9/237; F21K 9/238; F21V 19/0015; F21V 19/002; F21V 19/0025; F21V 21/0824; F21S 10/043
See application file for complete search history.

(56) References Cited

U.S. PATENT DOCUMENTS 5,924,784 A * 7/1999 Chliwnyj ..... F21V 3/04 362/234
9,874,315 B1 * 1/2018 Lin ..... F21K 9/66
(Continued)

*Primary Examiner* — Alexander K Garlen
*Assistant Examiner* — James M Endo
(74) *Attorney, Agent, or Firm* — Yee & Associates, P.C.

(57) ABSTRACT

A flame lamp made of filament lamps, including a fixing device, a controller and one or a plurality of LED filament lamps, wherein the LED filament lamps are fixedly installed on the fixing device and electrically connected with the controller, and the controller is used for controlling the light emitting frequency and pulse brightness of the LED filament lamps. Each LED filament lamp includes at least two light sources from top to bottom, wherein the light emitting frequencies and/or the pulse brightnesses of the at least two light sources are different. Each LED filament lamp is vertically arranged, and the upper end and the lower end of each LED filament lamp are fixedly connected with the fixing device. Various specific assembly methods are provided. The present invention innovatively makes a flame lamp of filament lamps and uses one or a combination of a plurality of filaments to achieve the luminous effect of a flame through different assembly structures and flashing methods, which can effectively simplify the production process, reduce production cost and provide a good visual effect.

1 Claim, 6 Drawing Sheets

(51) Int. Cl.
*F21V 21/08* (2006.01)
*F21Y 115/10* (2016.01)

(56) References Cited

U.S. PATENT DOCUMENTS

| | | | | |
|---|---|---|---|---|
| 10,415,764 | B1* | 9/2019 | Lei | F21K 9/238 |
| 2003/0201874 | A1* | 10/2003 | Wu | A01M 29/16 340/384.2 |
| 2004/0212321 | A1* | 10/2004 | Lys | H05B 47/155 315/291 |
| 2005/0135101 | A1* | 6/2005 | Richmond | F21S 9/037 362/276 |
| 2010/0253221 | A1* | 10/2010 | Chiang | F21K 9/232 315/32 |
| 2014/0369036 | A1* | 12/2014 | Feng | F21K 9/23 362/223 |
| 2014/0375201 | A1* | 12/2014 | Su | F21V 29/83 313/35 |
| 2016/0323972 | A1* | 11/2016 | Bora | H05B 45/24 |
| 2017/0122499 | A1* | 5/2017 | Lin | F21V 23/003 |
| 2017/0227169 | A1* | 8/2017 | Jiang | F21K 9/235 |
| 2018/0031185 | A1* | 2/2018 | Pettmann | F21K 9/272 |
| 2018/0066812 | A1* | 3/2018 | Fan | F21K 9/235 |
| 2018/0245744 | A1* | 8/2018 | Li | H05B 45/00 |
| 2018/0252371 | A1* | 9/2018 | Chelf | F21V 3/00 |
| 2018/0306386 | A1* | 10/2018 | Liang | F21K 9/238 |
| 2018/0328543 | A1* | 11/2018 | Bergmann | H01L 25/0753 |
| 2018/0347766 | A1* | 12/2018 | Choi | H01L 25/0753 |
| 2018/0372278 | A1* | 12/2018 | Zhang | F21K 9/232 |
| 2019/0093831 | A1* | 3/2019 | Jiang | F21K 9/90 |
| 2019/0195435 | A1* | 6/2019 | Ye | F21K 9/232 |
| 2019/0331302 | A1* | 10/2019 | Cai | F21V 29/70 |
| 2019/0342967 | A1* | 11/2019 | Yu | H01R 43/20 |

* cited by examiner

FLAME LAMP MADE OF FILAMENT LAMPS

TECHNICAL FIELD

The present invention relates to the field of lighting fixture products, and particularly relates to a flame lamp made of filament lamp light sources.

BACKGROUND

An LED light source has the advantages of environmental protection, high light efficiency, no radiation and low power consumption, and belongs to green energy-saving and environment-friendly lighting, so lighting products with LED as a light source are popular among users all over the world. In recent years, people have more aesthetic needs for lighting fixtures. Flame is visible light or other physical manifestations that appear during the chemical process in which fuel and air are mixed and quickly converted into combustion products. Burning will generate heat and light to form a variety of disorderly shaking or stringing bright and dark flames, giving people a very beautiful visual experience. As a result, LED simulation flame lamps appear on the market, which have novel shapes and better simulate the lighting effect of flames so that LED lamps are improved qualitatively in the luminous effect. However, LED flame lamps on the current market are made of a plurality of LED patches mounted on a FPC or PCB board, and have multiple light source granules, complex processing technology and high cost. It is necessary to correct the above problems and design a flame lamp with simple process and realistic simulation effect.

SUMMARY

A technical problem to be solved by the present invention is to provide a flame lamp made of filament lamps with reasonable structural design and realistic effect aiming at the problems of the prior art.

A technical solution adopted to solve the technical problems by the present invention is as follows: a flame lamp made of filament lamps, comprises a fixing device, a controller and one or a plurality of LED filament lamps, wherein the LED filament lamps are fixedly installed on the fixing device and electrically connected with the controller, and the controller is used for controlling the light emitting frequency and pulse brightness of the LED filament lamps.

Further, each LED filament lamp comprises at least two light source arrays from top to bottom, wherein the light emitting frequencies and/or the pulse brightnesses of at least two light source arrays are different.

Further, each LED filament lamp comprises two upper and lower light source arrays, and the light emitting frequencies and the pulse brightnesses of the two upper and lower light source arrays are different.

Further, the upper end and the lower end of each LED filament lamp can receive different signals.

Further, each LED filament lamp is vertically arranged, and the upper end and the lower end of each LED filament lamp are fixedly connected with the fixing device.

Further, one specific structure of the fixing device is provided: the fixing device comprises upper support rods, a middle support part and lower support rods, and one LED filament lamp is fixedly installed on the upper support rods.

Further, another specific structure of the fixing device is provided: each upper support rod comprises a horizontal upper support rod and a longitudinal upper support rod which are crisscross, the horizontal upper support rod is symmetrically provided with two LED filament lamps, the longitudinal upper support rod is symmetrically provided with two LED filament lamps, and the horizontal upper support rod is lower than the longitudinal upper support rod.

Further, another specific structure of the fixing device is provided: the fixing device comprises a short support rod and a long support rod, the LED filament lamps comprise a first LED filament lamp and a second LED filament lamp from top to bottom, the two LED filament lamps are connected end to end and are on the same vertical line, the lower end of the short support rod is fixedly connected with the lower end of the first LED filament lamp, and the lower end of the long support rod is fixedly connected with the second LED filament lamp.

Further, a flame lamp using the above structure of the fixing device is provided, the flame lamp also comprises a fixed plate, a first lamp shade, a second lamp shade, a battery compartment, an upper cover plate, a reflecting cone, a connecting rod and an underthrust fixed seat, the upper end of the fixing device is fixedly installed on the fixed plate, the fixing device is sequentially covered with the first lamp shade and the second lamp shade, the battery compartment is fixed above the fixed plate and electrically connected with the LED filament lamps, the upper cover plate is fixed above the battery compartment, the reflecting cone is fixed under the LED filament lamps, the lower end of the second lamp shade is fixedly connected with the connecting rod, and the lower end of the connecting rod is fixedly connected with the underthrust fixed seat.

Compared with the prior art, the flame lamp made of filament lamps of the present invention has the following beneficial effects: the present invention innovatively makes a flame lamp of filament lamps and uses one or a combination of a plurality of filaments to achieve the luminous effect of a flame through different assembly structures and flashing methods, which can effectively simplify the production process, reduce production cost and provide a good visual effect, and the present invention can achieve 360° full-angle light emission to form a stereoscopic light source with a 3D effect, which can enhance the realness and create an atmosphere, thus having good promotion and application values.

Figure 1:
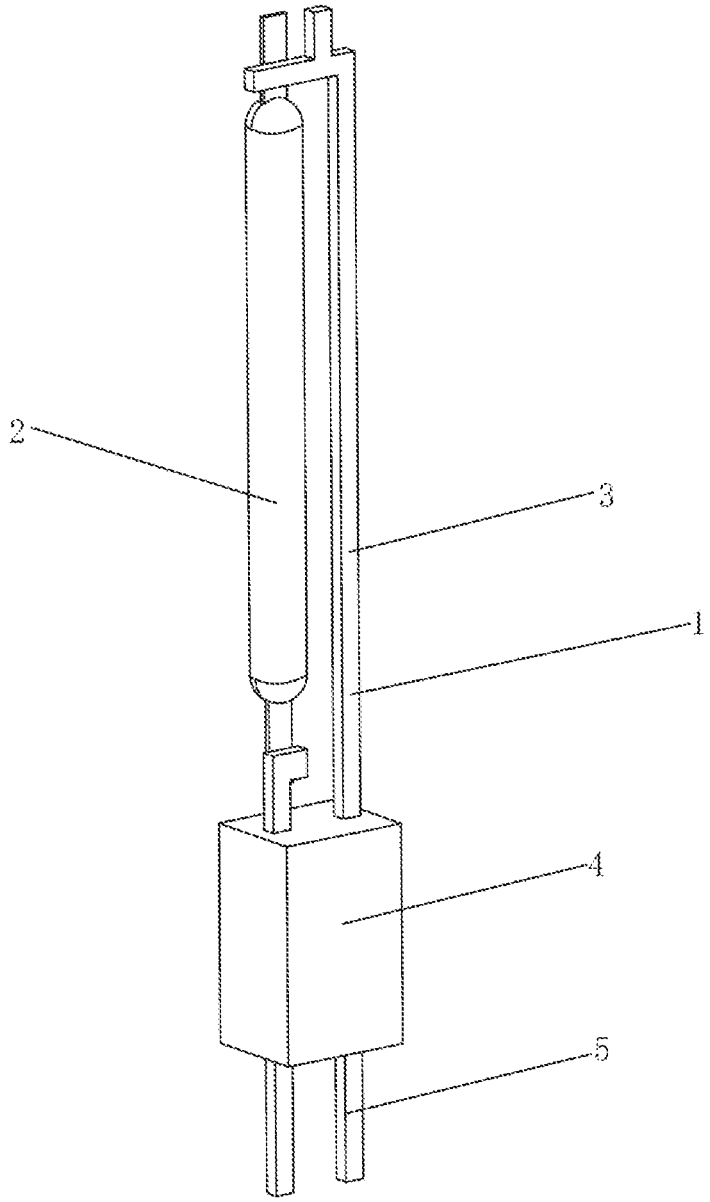
FIG. 1 is a stereogram of embodiment 1 of a flame lamp made of filament lamps of the present invention.
Figure 2:
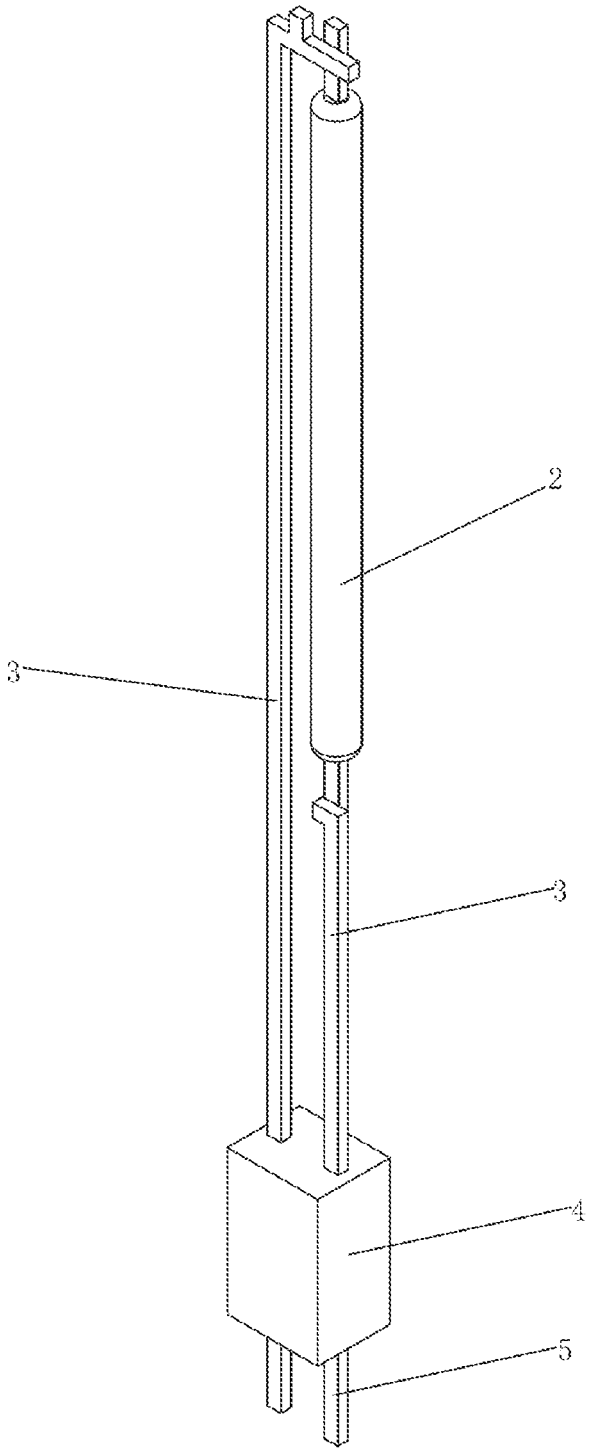
FIG. 2 is a stereogram of embodiment 2 of a flame lamp made of filament lamps of the present invention.
Figure 3:
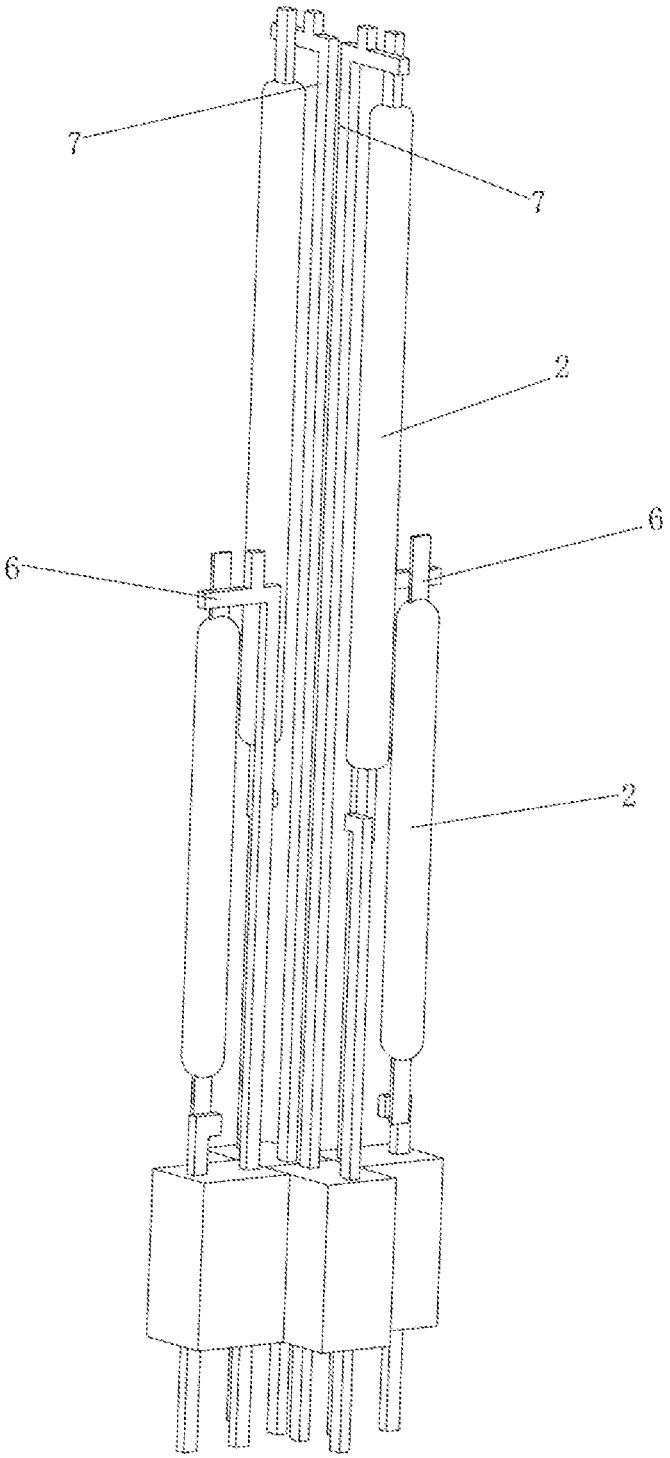
FIG. 3 is a stereogram of embodiment 3 of a flame lamp made of filament lamps of the present invention.
Figure 4:
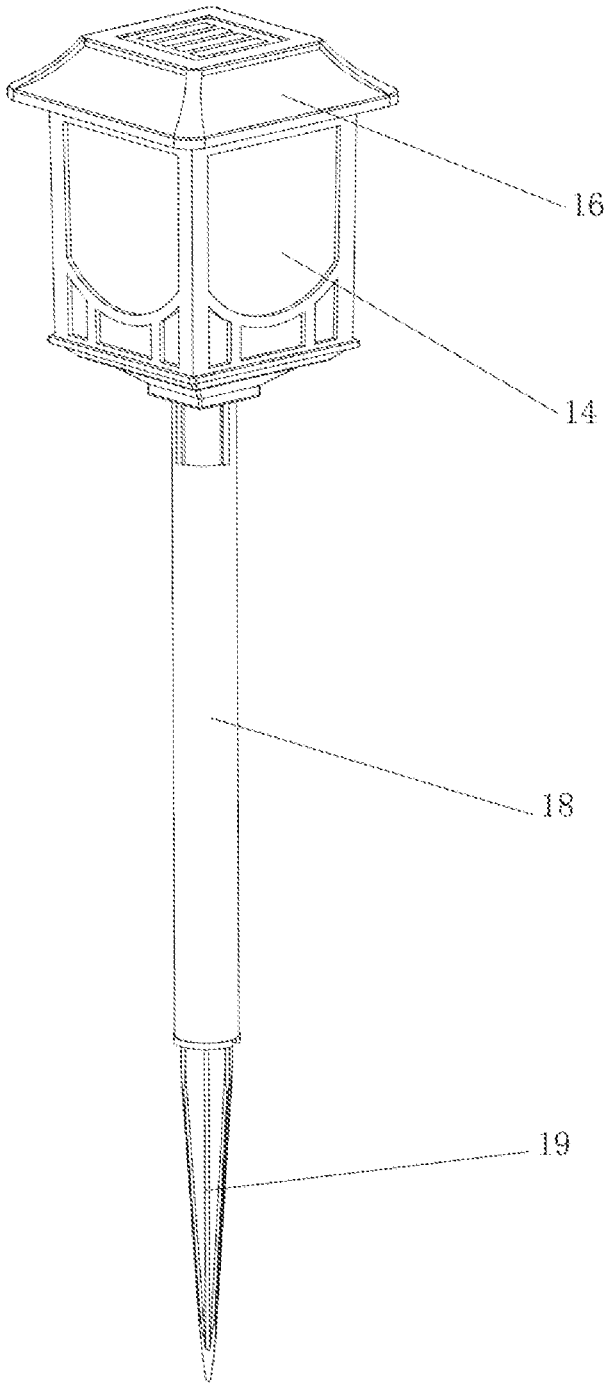
FIG. 4 is a stereogram of embodiment 4 of a flame lamp made of filament lamps of the present invention.
Figure 5:
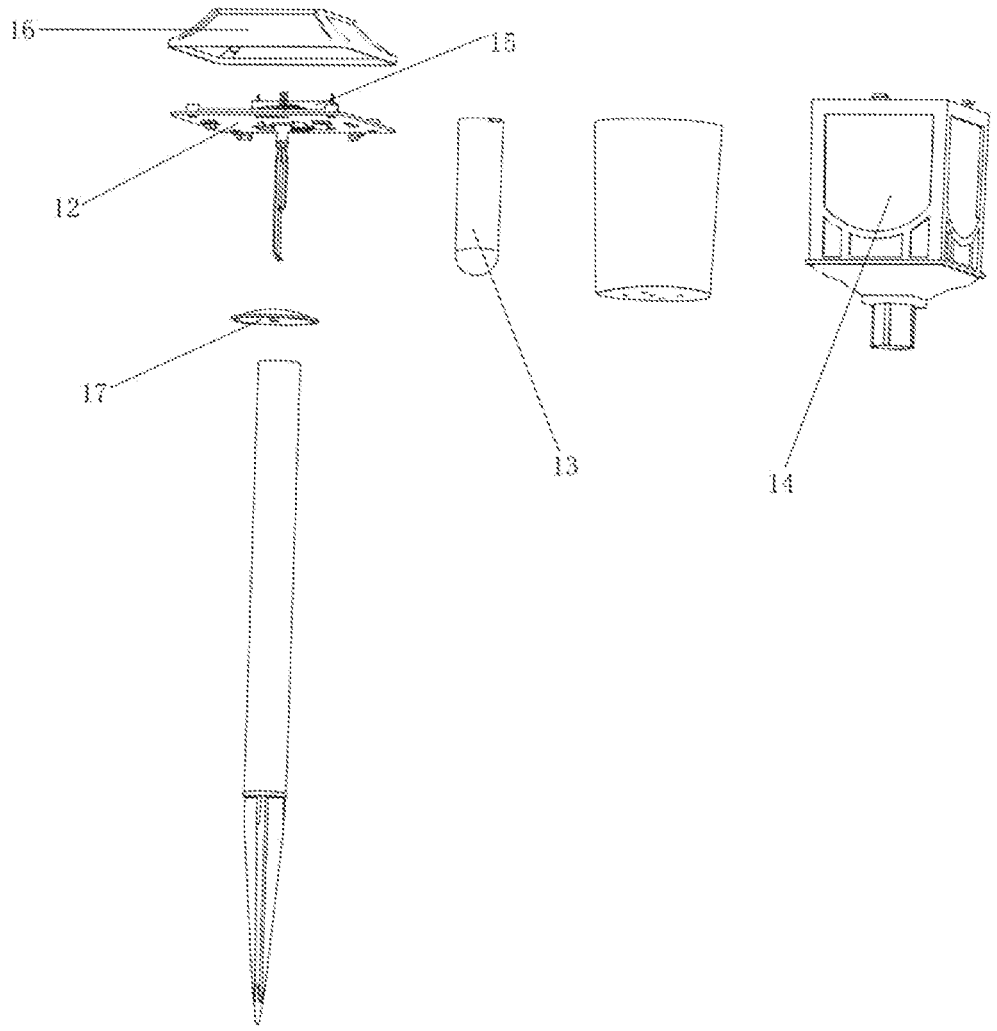
FIG. 5 is an exploded view of embodiment 4 of a flame lamp made of filament lamps of the present invention.
Figure 6:
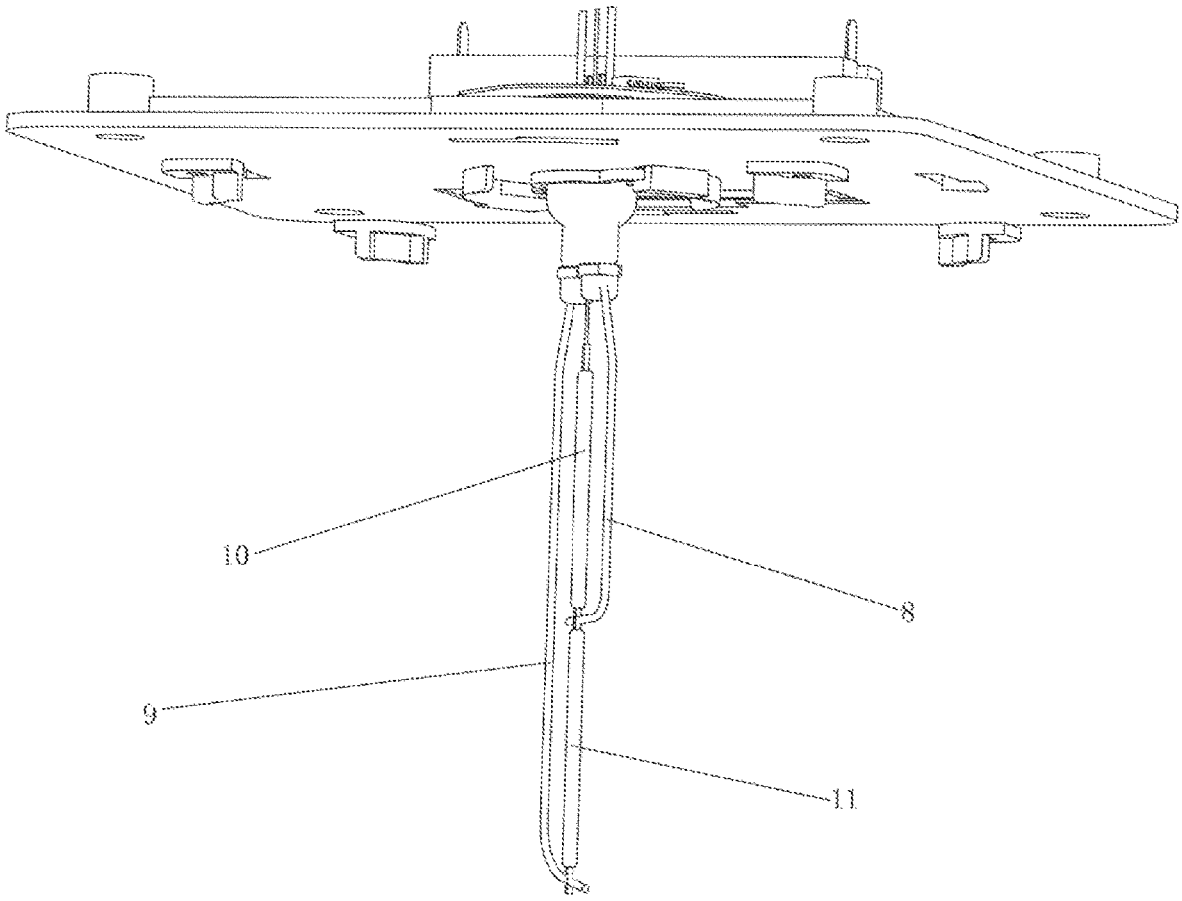
FIG. 6 is a partial enlarged view of embodiment 4 of a flame lamp made of filament lamps of the present invention.

Reference Signs: 1 fixing device; 2. LED filament lamp; 3. upper support rod; 4. middle support part; 5. lower support rod; 6. horizontal upper support rod; 7. longitudinal upper support rod; 8. short support rod; 9. long support rod; 10. first LED filament lamp; 11. second LED filament lamp; 12. fixed plate; 13. first lamp shade; 14. second lamp shade;

15. battery compartment; 16. upper cover plate; 17. reflecting cone; 18. connecting rod; and 19. underthrust fixed seat.

DETAILED DESCRIPTION

The present invention is further described below in detail in combination with the drawings and embodiments.

As shown in FIG. 1 to FIG. 6, a flame lamp made of filament lamps, comprises a fixing device 1, a controller and several LED filament lamps 2, i.e., one or a plurality of LED filament lamps 2, wherein the LED filament lamps 2 are fixedly installed on the fixing device 1 and electrically connected with the controller, and the controller is used for controlling the light emitting frequency and pulse brightness of the LED filament lamps 2 to realize simulation of the flame lighting effect. The pulse brightness means the brightness of the LED filament lamps 2 adjusted by the change of the current.

Each LED filament lamp 2 comprises at least two light source arrays from top to bottom, wherein the light emitting frequencies and/or the pulse brightnesses of at least two light source arrays are different. In other words, among the light source arrays of the same LED filament lamp 2, at least one light source array has the light emitting frequency and/or pulse brightness different from other light source arrays. In addition, the light source array means the sum of all light emitting components within a vertical range.

With the LED filament lamp 2 with two light source arrays as an example, each LED filament lamp 2 comprises two upper and lower light source arrays, and the light emitting frequencies and the pulse brightnesses of the two light source arrays are different.

The controller can send different signals to the upper end and the lower end of each LED filament lamp 2, and the LED filament lamp 2 realizes adjustment on the light emitting frequency and pulse brightness by receiving different signals.

The LED filament lamp 2 comprises a first fluorescent rubber strip and a second fluorescent rubber strip installed by butting, and a chip support arranged between the first fluorescent rubber strip and the second fluorescent rubber strip, wherein a plurality of LED chips are evenly arranged on the chip support, and the LED chips are evenly arranged along the chip support horizontally and are in positive and negative parallel connection with each other by conducting wires. In addition, metal wire lugs are installed at both ends of the chip support.

Each LED filament lamp 2 is vertically arranged, and the upper end and the lower end of each LED filament lamp 2 are fixedly connected with the fixing device 1. In addition, the flame lamp also comprises a switch which is used for controlling the on and off of the flame lamp.

Specifically, based on the above basic structure, the following specific assembly structure of the flame lamp is provided:

Embodiment 1

As shown in FIG. 1, the fixing device 1 comprises upper support rods 3, a middle support part 4 and lower support rods 5, and one LED filament lamp 2 is fixedly installed on the upper support rods 3 which are short.

Embodiment 2

The difference from embodiment 1 is that the upper support rods 3 in embodiment 2 are longer than those in embodiment 1 and are suitable for different application scenarios.

Embodiment 3

The difference from embodiment 2 is that each upper support rod 3 comprises a horizontal upper support rod 6 and a longitudinal upper support rod 7 which are crisscross, the horizontal upper support rod 6 is symmetrically provided with two LED filament lamps 2, the longitudinal upper support rod 7 is symmetrically provided with two LED filament lamps 2, the horizontal upper support rod 6 is lower than the longitudinal upper support rod 7, and the high and low staggered arrangement makes the effect of simulating a flame more realistic.

Embodiment 4

The fixing device 1 comprises a short support rod 8 and a long support rod 9, the LED filament lamps 2 comprise a first LED filament lamp 10 and a second LED filament lamp 11 from top to bottom, the two LED filament lamps 2 are connected end to end and are on the same vertical line, the lower end of the short support rod 8 is fixedly connected with the lower end of the first LED filament lamp 10, and the lower end of the long support rod 9 is fixedly connected with the second LED filament lamp 11.

In addition, in the embodiment, a flame lamp made of filament lamps, also comprises a fixed plate 12, a first lamp shade 13, a second lamp shade 14, a battery compartment 15, an upper cover plate 16, a reflecting cone 17, a connecting rod 18 and an underthrust fixed seat 19, the upper end of the fixing device 1 is fixedly installed on the fixed plate 12, the fixing device 1 is sequentially covered with the first lamp shade 13 and the second lamp shade 14, the battery compartment 15 is fixed above the fixed plate 12 and electrically connected with the LED filament lamps 2, the upper cover plate 16 is fixed above the battery compartment 15, the reflecting cone 17 is fixed under the LED filament lamps 2, the lower end of the second lamp shade 14 is fixedly connected with the connecting rod 18, the lower end of the connecting rod 18 is fixedly connected with the underthrust fixed seat 19, and the lower part of the underthrust fixed seat 19 is a pointed end which can be inserted into the soil for fixing or inserted in the lawn to create the interest and atmosphere of lighting.

To sum up, the fixing device 1 has various structures, one or a plurality of LED filament lamps 2 can be fixed, and the LED filament lamps 2 have various assembly methods.

Finally, it should be noted that the above embodiments are not to define the corresponding structure; and the above embodiments are used for describing the technical solution of the present invention rather than limiting the same. Although the present invention is described in detail by referring to the above embodiments, those ordinary skilled in the art should understand that: the technical solution recorded in each of the above embodiments can be still amended, or some technical features therein can be replaced equivalently. However, these amendments or replacements do not enable the essence of the corresponding technical solution to depart from the spirit and the scope of the technical solution of various embodiments of the present invention.

The invention claimed is:

1. A flame lamp made of filament lamps, comprising:

a fixing device (1), a controller and one or a plurality of LED filament lamps (2);

wherein the one or plurality of LED filament lamps (2) are fixedly installed on the fixing device (1) and electrically connected with the controller, and the controller controls the light emitting frequency and pulse brightness of the one or plurality of LED filament lamps (2);

wherein each LED filament lamp (2) includes at least two light sources from top to bottom, wherein the light emitting frequencies and/or the pulse brightnesses of the at least two light sources are different;

wherein each LED filament lamp (2) comprises two upper and lower light sources, and the light emitting frequencies and the pulse brightnesses of the two upper and lower light sources are different;

characterized in that each LED filament lamp (2) is vertically arranged, and the upper end and the lower end of each LED filament lamp (2) are fixedly connected with the fixing device (1);

characterized in that the fixing device (1) comprises upper support rods (3), a middle support part (4) and lower support rods (5), and one LED filament lamp (2) is fixedly installed on each of the upper support rods (3);

wherein each upper support rod (3) comprises a horizontal upper support rod (6) and a longitudinal upper support rod (7) which are crisscross, the horizontal upper support rod (6) is symmetrically provided with two LED filament lamps (2) and the longitudinal upper support rod (7) is symmetrically provided with two LED filament lamps (2), wherein the horizontal upper support rod (6) is arranged lower than the longitudinal upper support rod (7); and wherein said LED filament lamps are fixed in a flame lamp wherein the flame lamp comprises a fixed plate (12), a first lamp shade (13), a second lamp shade (14), a battery compartment (15), an upper cover plate (16), a reflecting cone (17), a connecting rod (18) and an underthrust fixed seat (19), wherein the upper end of the fixing device (1) of the said filament lamps is fixedly installed on the fixed plate (12), the fixing device (1) is sequentially covered with the first lamp shade (13) and the second lamp shade (14), the battery compartment (15) is fixed above the fixed plate (12) and electrically connected with the LED filament lamps (2), the upper cover plate (16) is fixed above the battery compartment (15), the reflecting cone (17) is fixed under the LED filament lamps (2), the lower end of the second lamp shade (14) is fixedly connected with the connecting rod (18), and the lower end of the connecting rod (18) is fixedly connected with the underthrust fixed seat (19).

* * * * *